US009434044B2

(12) United States Patent
Kosuge et al.

(10) Patent No.: US 9,434,044 B2
(45) Date of Patent: Sep. 6, 2016

(54) POLISHING APPARATUS

(71) Applicant: EBARA CORPORATION, Tokyo (JP)

(72) Inventors: Ryuichi Kosuge, Tokyo (JP); Hiroshi Sotozaki, Tokyo (JP); Takahiro Kawano, Tokyo (JP); Akihiro Mochida, Tokyo (JP)

(73) Assignee: Ebara Corporation, Tokyo (JP)

( * ) Notice: Subject to any disclaimer, the term of this patent is extended or adjusted under 35 U.S.C. 154(b) by 28 days.

(21) Appl. No.: 14/668,866

(22) Filed: Mar. 25, 2015

(65) Prior Publication Data

US 2015/0273649 A1 Oct. 1, 2015

(30) Foreign Application Priority Data

Mar. 27, 2014 (JP) ..... 2014-066729

(51) Int. Cl.
*B24B 37/00* (2012.01)
*B24B 37/005* (2012.01)

(52) U.S. Cl.
CPC ..... *B24B 37/0053* (2013.01)

(58) Field of Classification Search
CPC ... B24B 49/12; B24B 37/013; B24B 37/205; B24B 49/04; B24B 37/04
USPC ..... 451/5, 6, 41, 285–290
See application file for complete search history.

(56) References Cited

U.S. PATENT DOCUMENTS 5,837,610 A * 11/1998 Lee ..... B24B 37/04 257/E21.243
5,851,140 A * 12/1998 Barns ..... B24B 37/32 451/288
6,024,630 A * 2/2000 Shendon ..... B24B 37/32 451/285
6,077,147 A * 6/2000 Yang ..... B24B 37/013 451/288
6,231,428 B1 * 5/2001 Maloney ..... B24B 49/16 451/287
6,251,215 B1 * 6/2001 Zuniga ..... B24B 37/30 156/345.12
6,872,130 B1 * 3/2005 Zuniga ..... B24B 37/32 451/287
6,890,249 B1 * 5/2005 Zuniga ..... B24B 37/32 451/177

(Continued)

FOREIGN PATENT DOCUMENTS

JP 2009-260142 11/2009
JP 2010-050436 3/2010
JP 2013-532588 8/2013

*Primary Examiner* — George Nguyen
(74) *Attorney, Agent, or Firm* — Baker & Hostetler LLP

(57) ABSTRACT

A polishing apparatus which can reduce scratches that are generated on a surface of a substrate during polishing by detecting a foreign matter such as a fragment of the substrate on an inner circumferential surface of a retaining ring for holding an edge portion (peripheral portion) of the substrate is disclosed. The polishing apparatus includes a polishing table having a polishing surface, and a top ring having a substrate holding surface to hold a beck surface of a substrate and a retaining ring to retain the substrate on the substrate holding surface. The top ring holds the substrate and presses the substrate against the polishing surface. The polishing apparatus includes an imaging device configured to image an inner circumferential surface of the retaining ring, and an image processor configured to process an image obtained by the imaging device to judge whether there is a foreign matter on the inner circumferential surface of the retaining ring.

14 Claims, 6 Drawing Sheets

(56) References Cited

U.S. PATENT DOCUMENTS

2001/0001755 A1* 5/2001 Sandhu ..... B23Q 15/013 451/5
2003/0092363 A1* 5/2003 Laursen ..... B24B 37/26 451/41
2006/0194511 A1* 8/2006 Nagayama ..... B24B 37/08 451/5
2007/0099545 A1* 5/2007 Mavliev ..... B24B 37/34 451/8
2009/0017726 A1* 1/2009 Swedek ..... B24B 37/013 451/5
2010/0015889 A1* 1/2010 Shimizu ..... B24B 37/013 451/5
2013/0102152 A1* 4/2013 Chao ..... B24B 37/32 438/692
2013/0196573 A1* 8/2013 Fukushima ..... B24B 37/32 451/36
2016/0074987 A1* 3/2016 Takahashi ..... B24B 37/005 451/5

* cited by examiner

POLISHING APPARATUS

CROSS REFERENCE TO RELATED APPLICATION

This document claims priority to Japanese Patent Application Number 2014-066729 filed Mar. 27, 2014, the entire contents of which are hereby incorporated by reference.

BACKGROUND

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) or ceria ($CeO_2$) therein is supplied onto a polishing surface of a polishing pad, a wafer is brought into sliding contact with the polishing pad, so that the wafer is polished.

A polishing apparatus for performing CMP has a polishing table that supports a polishing pad thereon, and a top ring for holding a wafer. In the case where the wafer is polished using such polishing apparatus, the top ring holds the wafer and presses the wafer against the polishing pad at a predetermined pressure. At this time, the polishing table and the top ring are moved relative to each other to bring the wafer into sliding contact with the polishing pad to thereby polish a surface of the wafer.

In the above-described polishing apparatus, because a frictional force is generated between the wafer and the polishing pad during polishing, this frictional force is received by the retaining ring to prevent the wafer from being slipped out of the lower part of the top ring. Further, the retaining ring presses the polishing pad to deform the polishing pad, so that a polishing pressure applied to an edge portion (peripheral portion) of the wafer is adjusted and thus the polishing amount of the edge portion (peripheral portion) of the wafer is controlled by the deformation of the polishing pad.

In the polishing apparatus described above, the wafer is brought into contact with an inner wall surface of the retaining ring at the time of top ring stabilizing, and chipping may occur. Here, "top ring stabilizing" refers to an operation to stabilize a pressure of an air bag (pressure chamber) of the top ring by adding a polishing process before starting actual process polishing. Since the retaining ring is made of a resin such as PEEK or PPS, when chipping of the wafer occurs, a fragment of the wafer cuts into (bites into) the inner wall of the retaining ring. As the number of polished wafers increases, the fragment of the wafer which has cut into the inner wall surface of the retaining ring falls onto the polishing pad, thus causing a scratch of the wafer surface.

SUMMARY OF THE INVENTION

According to an embodiment, there is provided a polishing apparatus which can reduce scratches that are generated on a surface of a substrate during polishing by detecting a foreign matter such as a fragment of the substrate on an inner circumferential surface of a retaining ring for holding an edge portion (peripheral portion) of the substrate.

Embodiments, which will be described below, relate to a polishing apparatus for polishing a substrate such as a semiconductor wafer by pressing the substrate against a polishing surface on a polishing table.

In an embodiment, there is provided a polishing apparatus comprising: a polishing table having a polishing surface; a top ring having a substrate holding surface to hold a beck surface of a substrate and a retaining ring to retain the substrate on the substrate holding surface, the top ring being configured to hold the substrate and to press the substrate against the polishing surface; an imaging device configured to image an inner circumferential surface of the retaining ring; and an image processor configured to process an image obtained by the imaging device to judge whether there is a foreign matter on the inner circumferential surface of the retaining ring.

According to the embodiment, when the top ring does not hold the substrate, the imaging device images the inner circumferential surface of the retaining ring, and the image processor processes the obtained image. Thus, it can be judged whether there is a foreign matter on the inner circumferential surface of the retaining ring. In the case where the foreign matter such as a chipping of a wafer is detected, measures such as issuing an alarm is taken, so that generation of scratches on the surface of the substrate caused by the foreign matter which falls down onto the polishing surface can be reduced in the subsequent polishing processes.

In an embodiment, the polishing apparatus further comprises a lighting configured to emit a light to the inner circumferential surface of the retaining ring.

According to the embodiment, since the lighting can emit the light to the inner circumferential surface of the retaining ring, even if the interior of the polishing apparatus is dark, the imaging device can image the inner circumferential surface of the retaining ring without hindrance.

In an embodiment, the lighting is turned on at the time of imaging by the imaging device, and is turned off after the imaging.

In an embodiment, the imaging device is arranged at a location where the imaging device images the inner circumferential surface of the retaining ring from obliquely below.

In an embodiment, the top ring is supported by a top ring head shaft through a top ring head so as to be oscillatable between a substrate transfer position for transferring the substrate to and from the top ring and a substrate polishing position above the polishing surface; and the imaging device is provided at a location adjacent to the top ring head shaft.

In an embodiment, the imaging device images the inner circumferential surface of the retaining ring when the top ring is located at the substrate transfer position.

In an embodiment, the imaging device images the inner circumferential surface of the retaining ring when the top ring does not hold the substrate.

In an embodiment, the retaining ring and the substrate holding surface are movable relative to each other in a vertical direction; and the imaging device images the inner circumferential surface of the retaining ring after a lower surface of the retaining ring is positioned lower than the substrate holding surface.

In an embodiment, the top ring comprises a membrane which is an elastic membrane configured to define a plurality of pressure chambers into which a pressurized fluid is supplied, and the top ring is configured to press the substrate against the polishing surface with a fluid pressure by supplying the pressurized fluid into the plurality of pressure chambers; and the lower surface of the retaining ring is positioned lower than the substrate holding surface by lifting the membrane constituting the substrate holding surface relative to the retaining ring.

In an embodiment, the top ring comprises a carrier configured to hold the membrane and a pressure chamber formed above the carrier; and the carrier is lifted to lift the membrane by creating a vacuum in the pressure chamber formed above the carrier.

In an embodiment, the top ring comprises a pressure chamber formed above the retaining ring; and the retaining ring is lowered to position the lower surface of the retaining ring lower than the substrate holding surface by allowing a pressure of the pressure chamber formed above the retaining ring to be atmospheric pressure.

In an embodiment, the Imaging device comprises a CCD camera.

In an embodiment, the foreign matter comprises a fragment of the substrate.

In an embodiment, the imaging device and the image processor are incorporated in the polishing apparatus, or are capable of being incorporated in an existing polishing apparatus.

According to the above-described embodiments, scratches that are generated on the surface of the substrate during polishing can be reduced by detecting the foreign matter such as a fragment of the substrate on the inner circumferential surface of the retaining ring for holding the edge portion (peripheral portion) of the substrate.

BRIEF DESCRIPTION OF THE DRAWINGS

FIG. 6A is a view showing the state when the substrate is removed from the top ring and FIG. 6B is a view showing the state when the inner circumferential surface of the retaining ring is imaged by the CCD camera.

DESCRIPTION OF EMBODIMENTS

Figure 1:
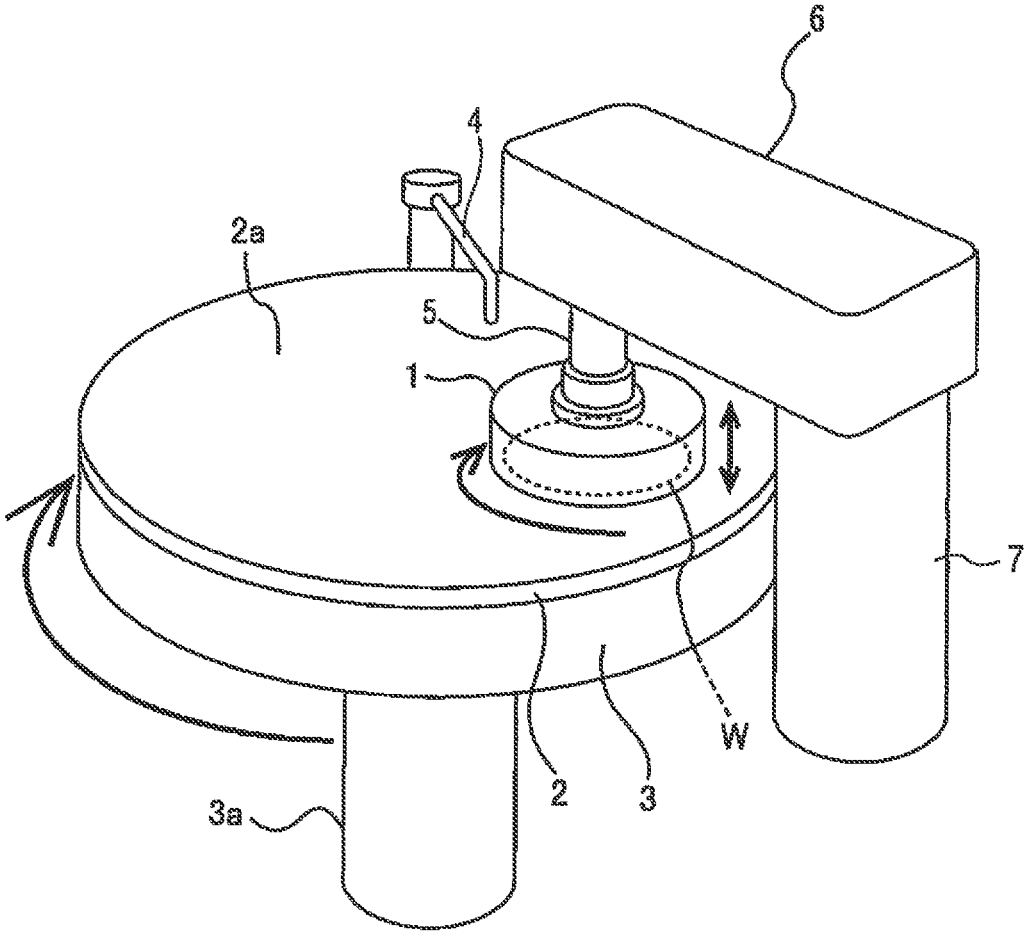
FIG. 1 is a schematic view showing an overall arrangement of a polishing apparatus according to an embodiment.

A polishing apparatus according to embodiments will be described in detail below with reference to FIGS. 1 to 7. In FIGS. 1 to 7, identical or corresponding parts are denoted by identical reference numerals throughout the views and their repetitive explanations will be omitted.

FIG. 1 is a schematic view showing an overall arrangement of a polishing apparatus according to an embodiment. As shown in FIG. 1, the polishing apparatus has a polishing table 3 supporting a polishing pad 2, and a top ring 1 for holding a substrate W such as a wafer as an object to be polished and pressing the substrate W against the polishing pad 2.

The polishing table 3 is coupled through a table shaft 3*a* to a motor (not shown) disposed below the polishing table 3, and is rotatable about the table shaft 3*a* by the motor. The polishing pad 2 is attached to an upper surface of the polishing table 3, and the upper surface of the polishing pad 2 constitutes a polishing surface 2*a* for polishing the substrate W. A polishing liquid supply nozzle 4 is provided above the polishing table 3 to supply a polishing liquid onto the polishing pad 2.

The top ring 1 is coupled to a top ring shaft 5 that is vertically moved by a vertically moving mechanism (not shown) disposed in a top ring head 6. When the top ring shaft 5 is moved up and down, the top ring 1 in its entirety is elevated and lowered relative to the top ring head 6 as indicated by an arrow, so that positioning of the top ring 1 is performed. The top ring shaft 5 is rotated by a rotating mechanism (not shown) housed in the top ring head 6. Thus, the top ring 1 is rotated about its own axis, as indicated by an arrow, by the rotation of the top ring shaft 5. The top ring head 6 is supported by a top ring head shaft 7 which is rotatably supported by a frame (not shown).

The top ring 1 is configured to hold the substrate W on its lower surface. The top ring head 6 is configured to be pivotable about the top ring shaft 7, so that the top ring 1, holding the substrate W on its lower surface, is moved from a substrate transfer position (pusher) to a substrate polishing position above the polishing table 3 by the pivotal movement of the top ring head 6. The top ring 1 is then lowered to press the substrate W against the polishing surface 2*a* of the polishing pad 2. At this time, the top ring 1 and the polishing table 3 are rotated respectively and the polishing liquid is supplied onto the polishing pad 2 from the polishing liquid supply nozzle 4 disposed above the polishing table 3. In this manner, the substrate W is brought into sliding contact with the polishing surface 2*a* of the polishing pad 2 in the presence of the polishing liquid between the polishing pad 2 and the substrate W, whereby the surface of the substrate W is polished. When polishing of the substrate W is completed, the top ring head 6 is pivoted about the top ring head shaft 7 to position the top ring 1 at the substrate transfer position (pusher), and the polished substrate W is removed (released) from the top ring 1.

Figure 2:
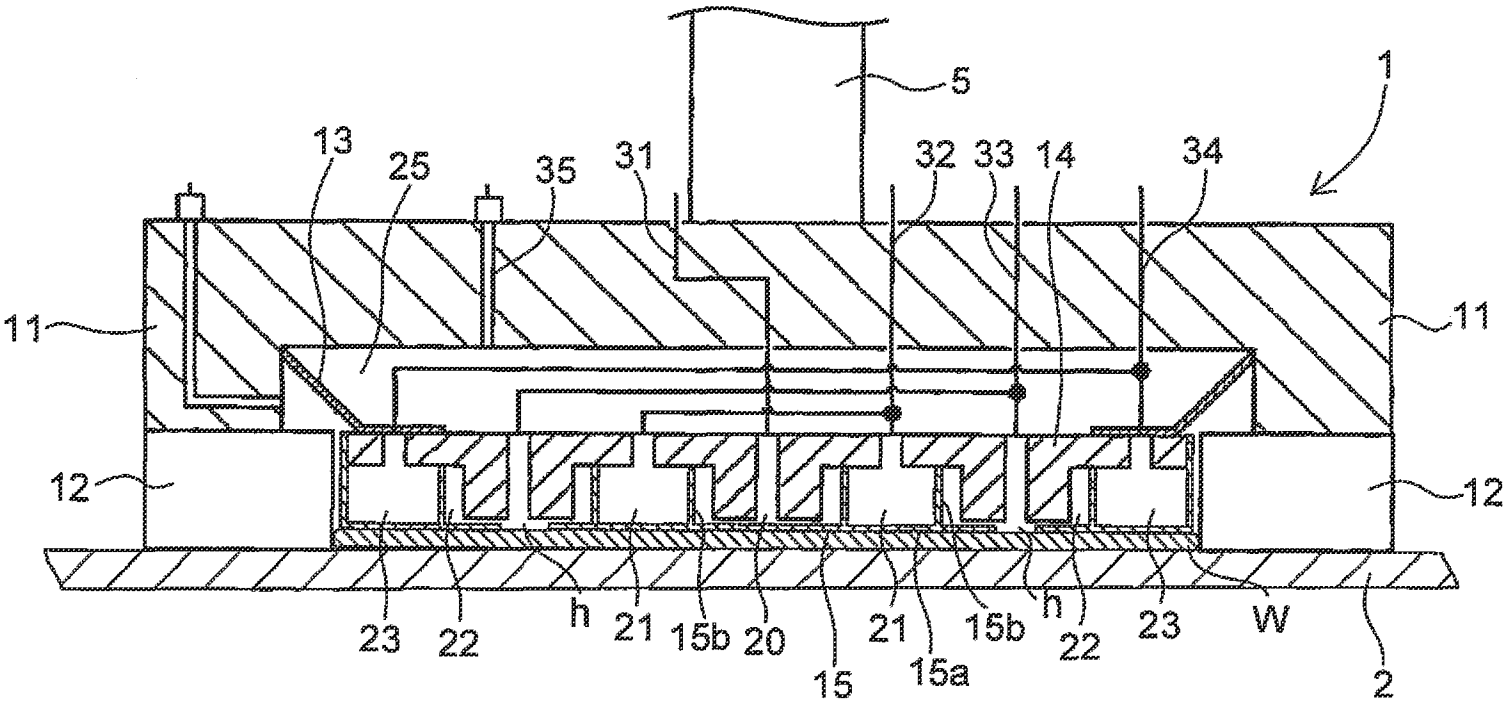
FIG. 2 is a cross-sectional view schematically showing a structure of a top ring.

Next, the structure of the top ring 1 will be described with reference to FIGS. 2 and 3. FIG. 2 is a cross-sectional view schematically showing the structure of the top ring 1. As shown in FIG. 2, the top ring 1 is connected to the lower end of the top ring shaft 5. The top ring 1 has a generally disc-shaped top ring body 11 and a retaining ring 12 arranged at a lower part of the top ring body 11. The top ring body 11 is made of a material having high strength and rigidity, which comprises a resin such as an engineering-plastic (e.g., PEEK), or a ceramic, or the like. The retaining ring 12 is made of a highly rigid resin material such as PEEK or PPS.

In a space formed inside the top ring body 11 and the retaining ring 12, an annular pressure sheet 13 made of an elastic membrane and fixed to the top ring body 11, and a generally disc-shaped carrier 14 held by the pressure sheet 13 are housed. A membrane (elastic membrane) 15, which is brought into contact with a back surface of the substrate W, is attached to a lower surface of the carrier 14. The membrane 15 has a lower surface which serves as a substrate holding surface 15*a*. The membrane 15 has a plurality of concentric partition walls 15*b* which define four pressure chambers: a central chamber 20; a ripple chamber 21; an outer chamber 22; and an edge chamber 23, which are located between the membrane 15 and the carrier 14. Pressurized fluid (e.g., pressurized air) is supplied into the pressure chambers 20, 21, 22, and 23 or vacuum is developed in the pressure chambers 20, 21, 22, and 23 through fluid passages 31, 32, 33, and 34, respectively. The central chamber 20, constituting a central pressure chamber, has a circular shape, and the ripple chamber 21, the outer chamber 22, and the edge chamber 23, constituting other pressure chambers, have an annular shape. These pressure chambers 20, 21, 22, and 23 are in a concentric arrangement.

Internal pressures of the pressure chambers 20, 21, 22, and 23 can be changed independently by a pressure regulator to thereby independently adjust pressing forces on four zones of the substrate W: a central portion; an inner intermediate portion; an outer intermediate portion; and a peripheral portion. Further, by elevating or lowering the top ring 1 in its entirety, the retaining ring 12 can press the polishing pad 2 at a predetermined pressing force. A pressure chamber 25 is formed between the carrier 14 and the top ring body 11. Pressurized fluid is supplied into the pressure chamber 25 or vacuum is developed in the pressure chamber 25 through a fluid passage 35. With these operations, the carrier 14 and the membrane (elastic membrane) 15 in their entirety can move up and down.

As shown in FIG. 2, the retaining ring 12 is arranged around the substrate W so as to prevent the substrate W from coming off the top ring 1 during polishing. The membrane 15 has an opening h in a portion that forms the outer chamber 22, so that the substrate W can be held by the top ring 1 via the vacuum suction by producing vacuum in the outer chamber 22. Further, the substrate W can be released from the top ring 1 by supplying nitrogen gas, dry air, compressed air, or the like into the outer chamber 22.

Figure 3:
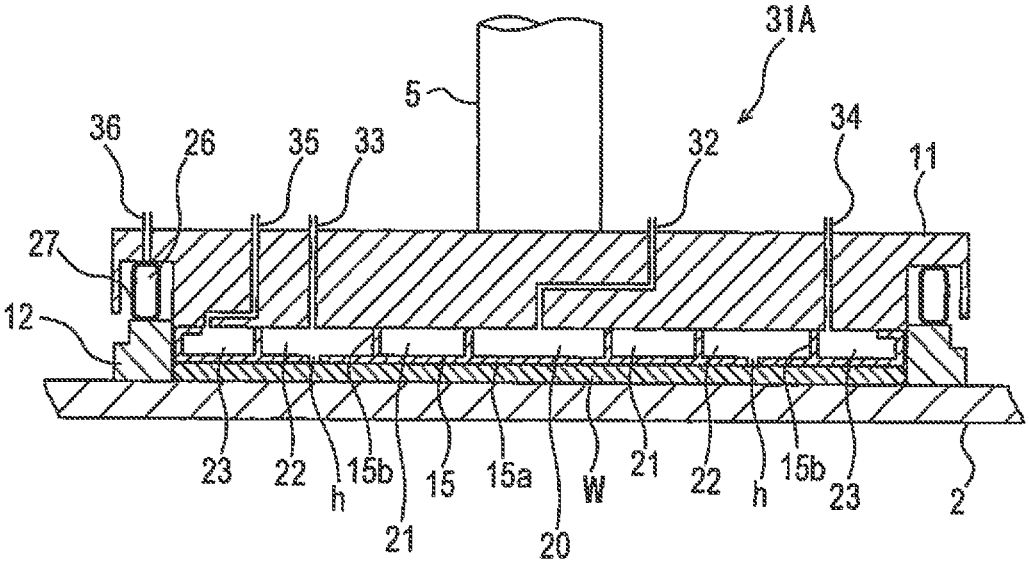
FIG. 3 is a cross-sectional view schematically showing another example of the top ring.

FIG. 3 is a cross-sectional view schematically showing another example of the top ring 1. In this example, the carrier 14 is not provided. The membrane 15 is attached to a lower surface of the top ring body 1. Further, the pressure chamber 25 is not provided between the carrier 14 and the top ring body 11. Instead, an elastic bag 27 is provided between the retaining ring 12 and the top ring body 11, and a pressure chamber 26 is formed in the elastic bag 27. The retaining ring 12 is movable in the vertical direction relative to the top ring body 11. A fluid passage 36 in fluid communication with the pressure chamber 26 is provided, so that the pressurized fluid (e.g., pressurized air) is supplied into the pressure chamber 26 through the fluid passage 36. Internal pressure of the pressure chamber 26 is adjustable by the pressure regulator. Therefore, the pressing force of the retaining ring 12 against the polishing pad 2 can be adjusted independently of the pressing force applied to the substrate W. Other structures and operations are identical to those of the top ring shown in FIG. 2. The embodiment can use either of the top ring shown in FIG. 2 or FIG. 3.

In the top ring 1 configured as shown in FIGS. 2 and 3, the substrate W such as a wafer is held by the substrate holding surface 15*a* of the membrane 15, and the membrane 15 is inflated to bring the lower surface (surface to be polished) of the substrate W into contact with the polishing surface 2*a* of the polishing pad 2. In this state, while the polishing table 3 and the top ring 1 are rotated, the substrate W is polished until the surface of the substrate W becomes in a predetermined state. During the polishing process, the peripheral portion of the substrate W is brought into contact with an inner circumferential surface of the retaining ring 12, and chipping of the substrate may occur. Since the retaining ring 12 is made of a resin such as PEEK or PPS, when chipping of the substrate occurs, a fragment of the substrate cuts into (bites into) an inner wall of the retaining ring 12. As the number of polished substrates increases, the fragment of the substrate which has cut into the inner circumferential surface of the retaining ring falls onto the polishing pad 2, thus causing scratches of the substrate surface.

Therefore, according to the embodiment, there is provided a foreign matter detection device for detecting a foreign matter such as a fragment of the substrate which has cut into the inner circumferential surface of the retaining ring 12 or an abrasive particle which has adhered to the inner circumferential surface of the retaining ring 12.

Figure 4:
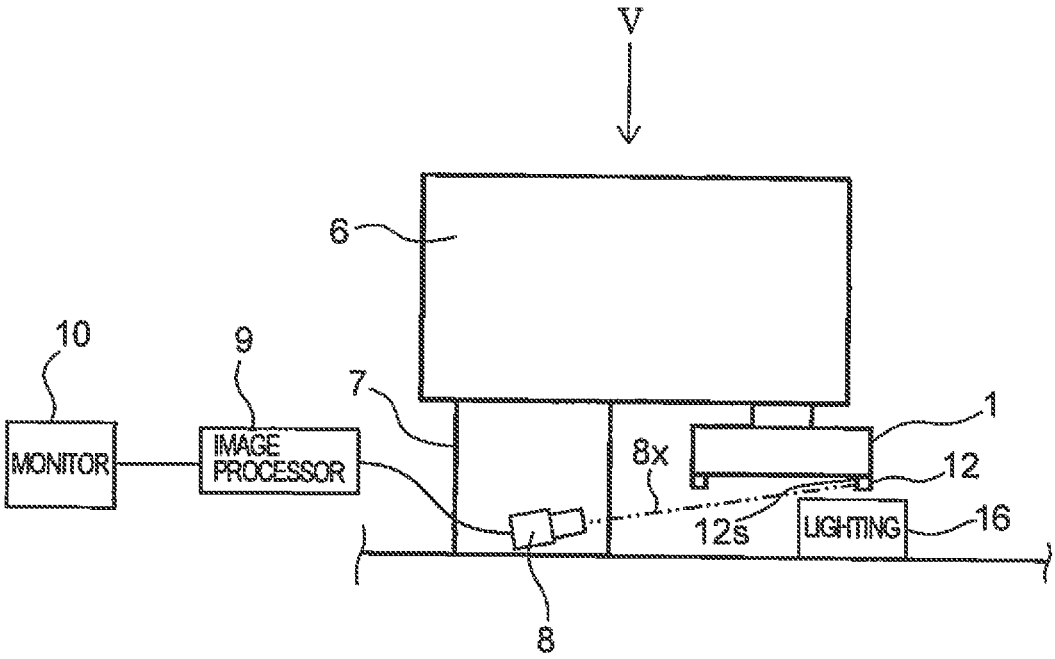
FIG. 4 is a schematic elevational view showing a foreign matter detection device installed in the polishing apparatus.
Figure 5:
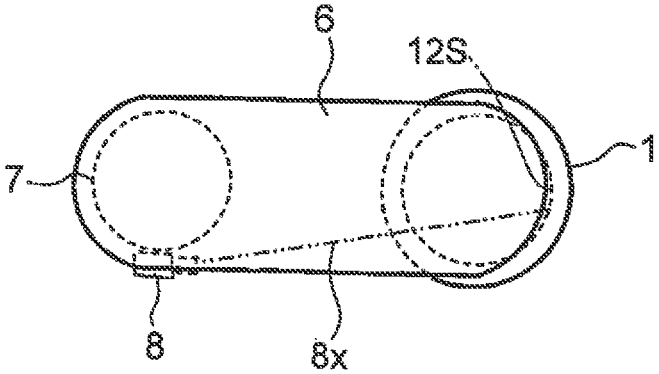
FIG. 5 is a view as viewed from V of FIG. 4.

FIG. 4 is a schematic elevational view showing a foreign matter detection device installed in the polishing apparatus. FIG. 5 is a view as viewed from V of FIG. 4. As shown in FIGS. 4 and 5, a CCD camera 8 constituting an imaging device is fixed to a location adjacent to the top ring head shaft 7 for supporting the top ring head 6, e.g., a floor part where the top ring head shaft 7 is provided. An optical axis 8*x* of the CCD camera 8 extends obliquely upward toward the inner circumferential surface 12S of the retaining ring 12 so that the CCD camera 8 can image the inner circumferential surface 12S of the retaining ring 12. The CCD camera 8 is connected to an image processor 9, which is connected to a monitor 10. A lighting 16 for emitting a light to the inner circumferential surface 12S of the retaining ring 12 is disposed below the top ring 1. The location where the CCD camera 8 is installed is not limited to the location adjacent to the top ring shaft 7, but may be any location where the inner circumferential surface of the retaining ring can be imaged from below the top ring. Such a location may be a floor part on which the polishing table is provided, a floor part on which a substrate transfer unit is provided, or a floor part between the polishing table and the substrate transfer position.

The foreign matter detection device configured as shown in FIGS. 4 and 5 operates as follows.

As shown in FIG. 4, when the top ring 1 is located at the substrate transfer position and does not hold the substrate W, the CCD camera 8 images the inner circumferential surface 12S of the retaining ring 12. Since the interior of the polishing apparatus is dark, at the time of imaging, the lighting 16 is turned on to apply a spotlight to the inner circumferential surface 12S of the retaining ring 12. The spotlight may be a visible light or infrared rays. The lighting 16 is turned off after imaging.

Particularly, in the case where the interior of the polishing apparatus is subjected to light shielding in order to inhibit oxidization of metal, such as copper, exposed on the substrate, a lighting in the interior of the polishing apparatus (particularly, in the interior of the polishing unit comprising the polishing table 3 and the top ring 1) is required in addition to the spotlight. The lighting is preferably turned on at the timing after the polished substrate is removed from the transfer position.

Figure 6A:
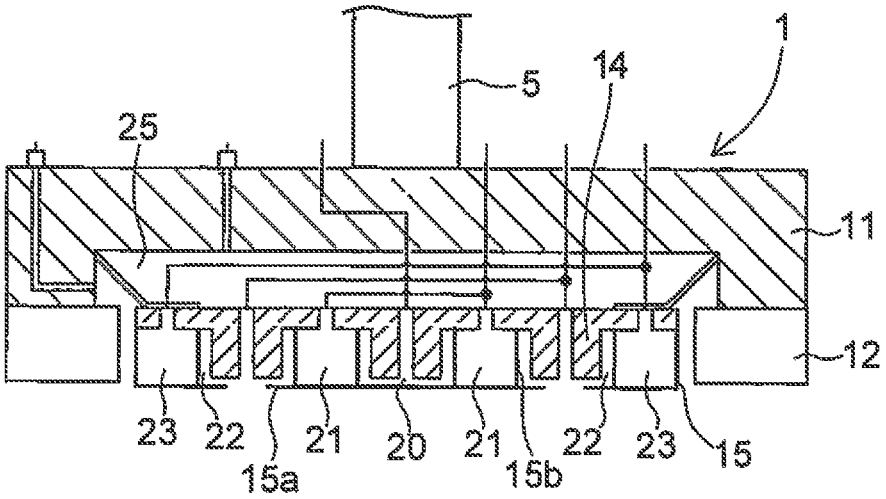
FIGS. 6A and 6B are schematic cross-sectional views showing the operation of the top ring configured as shown in FIG. 2.
Figure 6B:
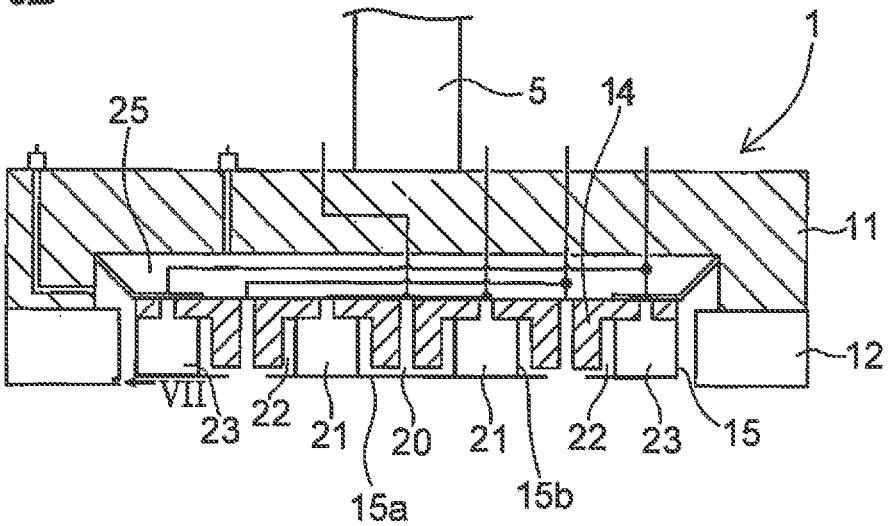

FIGS. 6A and 6B are schematic cross-sectional views showing the operation of the top ring 1 configured as shown in FIG. 2. FIG. 6A is a view showing the state when the substrate W is removed from the top ring 1, and FIG. 6B is a view showing the state when the inner circumferential surface 12S of the retaining ring 12 is imaged by the CCD camera 8. As shown in FIG. 6A, when the substrate W is removed from the top ring 1, the substrate holding surface 15*a* slightly projects from the lower surface of the retaining ring 12. At the time of imaging by the CCD camera 8, the pressure chamber 25 of the top ring 1 is connected to a vacuum source (not shown) to create a vacuum in the pressure chamber 25, and thus the carrier 14 is lifted to lift the membrane 15 constituting the substrate holding surface 15*a* as shown in FIG. 6B. Thus, as shown in FIG. 6B, the lower surface of the retaining ring 12 is positioned lower than the substrate holding surface 15*a* to allow the inner circumferential surface 12S of the retaining ring 12 to be exposed, thereby creating a state in which the inner circumferential surface 12S can be imaged by the CCD camera 8. In the top ring 1 shown in FIG. 3, the pressure chamber 26 is unpressurized so as to be atmospheric pressure, thereby lowering the retaining ring 12 by its own weight. Thus, the lower surface of the retaining ring 12 is positioned lower than the substrate holding surface 15*a* to allow the inner circumferential surface 12S of the retaining ring 12 to be exposed, thereby creating a state in which the inner circumferential surface 12S can be imaged by the CCD camera 8. By the above measures, a foreign matter such as a chipping of the substrate (wafer) on the inner circumferential surface 12S can be observed.

Figure 7:
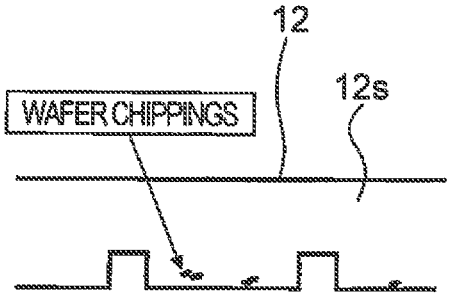
FIG. 7 is a view as viewed from VII of FIG. 6B.

FIG. 7 is a view as viewed from VII of FIG. 6B. As shown in FIG. 7, the state in which wafer chippings cut into the inner circumferential surface 12S of the retaining ring 12 is observed. During imaging by the CCD camera 8, the top ring 1 is made one revolution, so that the entire circumference of the inner circumferential surface 12S of the retaining ring 12 is imaged. In consideration of photocorrosion, imaging is performed at the time of dummy dispense, during which the substrate (wafer) is not positioned in the apparatus. Here, "dummy dispense" refers to dispensing pure water periodically to prevent the top ring, the polishing pad, and the like from being dried during a standby state when polishing is not performed. In order to prevent bacterium from generating in a cleaning pipe and to prevent a slurry line from being clogged, pure water is dispensed periodically.

The images of the entire circumference of the inner circumferential surface 12S obtained by the CCD camera 8 are processed by the image processor 9. If there is a foreign matter such as a chipping of the substrate (wafer) on the inner circumferential surface 12S, the foreign matter is observed in the image as a brighter region or a darker region in a background having predetermined brightness. By distinguishing the region brighter than the background or the region darker than the background by the image processor 9, the foreign matter can be detected. Further, the chipping of the wafer, and the retaining ring can be distinguished by the contrast of their colors. Specifically, in the case where the retaining ring is white, the wafer is blackish, and therefore the chipping can be detected based on the contrast of their colors. Since the inner surface of the retaining ring is cleaned and dirt is basically rinsed out by spraying pure water or the like onto the inner surface of the retaining ring before imaging the chipping by the CCD camera, misdetection in which dirt adhering to the inner surface of the retaining ring is detected as a chipping is prevented. Although water droplets remain on the inner surface of the retaining ring, misdetection is avoided because a slurry used is white, and is not black even if the slurry is slightly solidified and adheres to the inner surface of the retaining ring. However, since there is a possibility of misdetection due to a shadow of a water droplet or the like, the number of chippings (e.g., in consideration of the number of shadows of water droplets, the number of chippings (including the number of shadows of water droplets or the like) to issue an alarm is determined) or the area of chippings (e.g., when the total area of chippings becomes a predetermined area ($mm^2$) or more because chippings which have different sizes and overlap one another are forced to be counted as one) is defined to issue an alarm.

The image processor 9 issues an alarm when detecting the foreign matter such as a fragment of the substrate (wafer). At the beginning of the dummy dispense state, detection of the foreign matter such as a chipping is performed, and if the foreign matter is detected, the alarm is issued. After issuing the alarm, the operation of the dummy dispense is continued as it is. As described above, the conditions for detecting the foreign matter depend on operations, including the number of foreign matters such as wafer fragments, the area of the foreign matter such as a wafer fragment, and the like. After detecting the foreign matter, the state of the foreign matter can be checked by the monitor 10, and then the image processor 9 can be reset.

In the case where the process does not affect photocorrosion, inspection of the foreign matter can be performed for each substrate or by specifying the number of substrates. If the foreign matter is detected during the process, the process is interlocked. The CCD camera 8 is enclosed by a cover and is purged with $N_2$ so as not to be corroded. In order to prevent imaging result from being affected by dirt of the cover, pure water is supplied onto the cover at all times so that the cover does not become dirty, and at the time of imaging, supply of pure water is stopped and $N_2$ gas is ejected onto the cover to remove water droplets. The cover is processed to apply hydrophilicity or water-repellency, so that misdetection due to water droplets is avoided. Similarly, the lighting 16 is enclosed by a cover and is purged with $N_2$. In order to prevent the lighting from being dimmed by the dirt of the cover, pure water is supplied onto the cover at all times so that the cover does not become dirty, and at the time of imaging, supply of pure water is stopped and $N_2$ gas is ejected onto the cover to remove water droplets. The cover is processed to apply hydrophilicity or water-repellency, so that diffusion of light caused by water droplets is avoided. As shown in FIG. 7, in the case of the retaining ring 12 having grooves, inspection of the foreign matter can be performed by eliminating the grooves by image processing.

Although the embodiments of the present invention have been described above, it should be noted that the present invention is not limited to the above embodiments, but may be reduced to practice in various different embodiments within the scope of the technical concept of the invention.

What is claimed is:

1. A polishing apparatus comprising:

a polishing table having a polishing surface;

a top ring having a substrate holding surface to hold a beck surface of a substrate and a retaining ring to retain the substrate on the substrate holding surface, the top ring being configured to hold the substrate and to press the substrate against the polishing surface;

an imaging device configured to image an inner circumferential surface of the retaining ring; and an image processor configured to process an image obtained by the imaging device to judge whether there is a foreign matter on the inner circumferential surface of the retaining ring.

2. The polishing apparatus according to claim 1, further comprising:

a lighting configured to emit a light to the inner circumferential surface of the retaining ring.

3. The polishing apparatus according to claim 2, wherein the lighting is turned on at the time of imaging by the imaging device, and is turned off after the imaging.

4. The polishing apparatus according to claim 1, wherein the imaging device is arranged at a location where the imaging device images the inner circumferential surface of the retaining ring from obliquely below.

5. The polishing apparatus according to claim 1, wherein the top ring is supported by a top ring head shaft through a top ring head so as to be oscillatable between a substrate transfer position for transferring the substrate to and from the top ring and a substrate polishing position above the polishing surface; and the imaging device is provided at a location adjacent to the top ring head shaft.

6. The polishing apparatus according to claim 5, wherein the imaging device images the inner circumferential surface of the retaining ring when the top ring is located at the substrate transfer position.

7. The polishing apparatus according to claim 1, wherein the imaging device images the inner circumferential surface of the retaining ring when the top ring does not hold the substrate.

8. The polishing apparatus according to claim 7, wherein the retaining ring and the substrate holding surface are movable relative to each other in a vertical direction; and the imaging device images the inner circumferential surface of the retaining ring after a lower surface of the retaining ring is positioned lower than the substrate holding surface.

9. The polishing apparatus according to claim 8, wherein the top ring comprises a membrane which is an elastic membrane configured to define a plurality of pressure chambers into which a pressurized fluid is supplied, and the top ring is configured to press the substrate against the polishing surface with a fluid pressure by supplying the pressurized fluid into the plurality of pressure chambers; and the lower surface of the retaining ring is positioned lower than the substrate holding surface by lifting the membrane constituting the substrate holding surface relative to the retaining ring.

10. The polishing apparatus according to claim 9, wherein the top ring comprises a carrier configured to hold the membrane and a pressure chamber formed above the carrier, and the carrier is lifted to lift the membrane by creating a vacuum in the pressure chamber formed above the carrier.

11. The polishing apparatus according to claim 8, wherein the top ring comprises a pressure chamber formed above the retaining ring; and the retaining ring is lowered to position the lower surface of the retaining ring lower than the substrate holding surface by allowing a pressure of the pressure chamber formed above the retaining ring to be atmospheric pressure.

12. The polishing apparatus according to claim 1, wherein the imaging device comprises a CCD camera.

13. The polishing apparatus according to claim 1, wherein the foreign matter comprises a fragment of the substrate.

14. The polishing apparatus according to claim 1, wherein the imaging device and the image processor are incorporated in the polishing apparatus, or are capable of being incorporated in an existing polishing apparatus.

* * * * *